United States Patent [19]

Pauza

[11] Patent Number: 4,744,774

[45] Date of Patent: May 17, 1988

[54] ELECTRICAL CONNECTOR HAVING CONDUCTIVE SHEATH-CLAMPING MEANS

[75] Inventor: William V. Pauza, Palmyra, Pa.

[73] Assignee: AMP Incorporated, Harrisburg, Pa.

[21] Appl. No.: 4,512

[22] Filed: Jan. 20, 1987

[51] Int. Cl.[4] ..... H01R 13/02

[52] U.S. Cl. ..... 439/225; 439/907; 439/394; 439/578; 439/860

[58] Field of Search ..... 339/177, 14, 147, 97, 339/98, 99 R, 154–157; 200/51; 439/225, 907, 578, 860

[56] References Cited

U.S. PATENT DOCUMENTS

| | | | |
|---|---|---|---|
| 2,785,385 | 3/1957 | Figueira | 339/177 R |
| 2,791,755 | 5/1957 | Hammell | 339/258 |
| 3,534,322 | 10/1970 | Hoffa | 339/177 R |
| 3,573,712 | 4/1971 | Shirey | 339/177 E |
| 3,617,983 | 11/1971 | Patton | 339/98 |
| 3,663,901 | 5/1972 | Forney, Jr. | 339/177 R |
| 3,678,446 | 7/1972 | Siebelist | 339/177 E |
| 3,760,335 | 9/1973 | Roberts | 339/99 R |
| 3,982,803 | 9/1976 | Bennett | 339/177 R |
| 4,126,372 | 11/1978 | Hashimoto et al. | 339/177 E |
| 4,256,935 | 3/1981 | Ito et al. | 339/177 R |
| 4,559,421 | 12/1985 | Lapke et al. | 339/154 A |

*Primary Examiner*—Gil Weidenfeld
*Assistant Examiner*—David Pirlot

[57] ABSTRACT

An electrical connector (10) for establishing an electrical connection between an outer conductive sheath (22, 22) of a cable (12*a*, 12*b*) to the connector (10) comprises an insulative fitting assembly (16, 17) having a first conductive member (42, 42) mounted thereto, an insulative connector housing assembly (14) having a second conductive member (19) mounted thereto. A cable (12*a*, 12*b*) having a portion of its conductive sheath (22, 22) exposed is extended through aligned passageways (43, 76, 43, 77) in the fitting (16, 17) and housing assembly (14). The first and second conductive members (42, 42, 19) include first and second, substantially radially extending, sheath-engaging surfaces (53, 53, 93, 94,) respectively, which clamp an exposed fanned-out portion of the conductive sheath (22, 22) therebetween when the fitting assembly (16, 17) is attached to the housing assembly (14).

19 Claims, 3 Drawing Sheets

ELECTRICAL CONNECTOR HAVING CONDUCTIVE SHEATH-CLAMPING MEANS

BACKGROUND OF THE INVENTION

The present invention relates generally to the field of electrical connectors and, more particularly, to an electrical connector having means for securing the outer conductive sheath of a cable to the connector.

U.S. Pat. No. 4,126,372 discloses a know electrical connector that comprises a first cone-shaped clamping jaw member having an axial passage for receipt of a coaxial cable. The clamping jaw member has a truncated conical end that tunnels concentrically under a cylindrical conductive sheath, also referred to as an outer conductor, of a coaxial cable. A second clamping jaw member is slidable over the conductive sheath. The first and second clamping jaw members are electrically conductive and clamp the conductive sheath therebetween to establish an electrical connection of the conductive sheath to the connector.

U.S. Pat. No. 4,126,372 discloses that the cylindrical conductive sheath of a coaxial cable may be flared outwardly or folded back in order to permit two conductive clamping jaw members to clamp the sheath therebetween. The clamping jaw members are formed with inclined wedge shapes which conform to either the flared or folded back shape of the sheath.

The conductive clamping jaw members of the apparatus disclosed in U.S. Pat. No. 4,126,372 are fabricated from thick metal parts having sufficient mass to withstand the clamping forces. The members are fabricated by manufacturing procedures which involve separately machining the members. Machining operations are capable of producing parts having precise dimensions and tolerances. However, the rate at which the parts are produced is slow, and the cost of their manufacture is relatively high. Machining operations, accordingly, are only suitable for producing parts in small quantities or when the need for high precision justifies a more costly manufacturing technique.

There is a large demand for electrical connectors which are capable of clamping the outer conductive sheath of a communications cable. This demand has spurred efforts to reduce the cost of such connectors, either by improving manufacturing techniques or by redesigning the connectors to eliminate the need for costly manufacturing techniques. A further reduction in cost can be realized if the connectors are designed for field application, defined as assembly of the connectors to cables at locations where the cables are installed for use. An even further cost reduction can be obtained if the connectors are capable of being assembled to cables by untrained workers without the need for special tools.

One expanding use for connectors capable of clamping the outer conductive sheath of a cable is in the field of premises wiring. Premises wiring carries voice, electronic data and/or electrical power over one or more electrical conductors and/or one or more optical fibers gathered together in a communications cable. Workstations consisting of various types of equipment situated at strategic locations in the same building or in separate buildings are linked to the cable by such connectors; and the cable, in turn, links the workstations to one another to receive or transmit communications information carried by the cable.

The cable may take various forms. For example, the cable may comprise a twisted-pair cable which is a cable containing insulated wires that are spirally twisted together in pairs. Alternatively, the cable may comprise a coaxial cable containing one or more insulated conductors surrounded by a cylindrical conductive sheath. Optical fiber cables may also contain a sheath surrounding the optical fibers within the cable to provide the cable with physical strength and to protect the fibers. Such a sheath may be electrically conductive to provide for a ground electrical potential along the sheath and along the length of the cable.

Connectors having parts fabricated from stamped and formed metal strip are significantly less costly than connectors having machined parts. An electrical connector having clamping jaws fabricated with stamped and formed metal strip and being sufficiently rugged to withstand the clamping forces applied by the jaws to the outer conductive sheath of a cable would be a highly desirable product.

SUMMARY OF THE INVENTION

The present invention comprises an electrical connector having clamping means for securing the outer conductive sheath of a cable to the connector for establishing a reliable electrical connection between the outer conductive sheath and the connector. In accordance with the invention, an electrical connector for a cable having a conductive outer sheath surrounding one or more center conductors is provided which comprises a first clamping member having a first axial passageway, the first clamping member comprising an insulative fitting and a first electrically conductive member mounted on the fitting and having a first, substantially radially extending, sheath-engaging surface; a second clamping member having a second axial passageway, the second clamping member comprising an insulative connector housing having center conductor connection means and a second electrically conductive member mounted on the housing and having a second, substantially radially extending, sheath-engaging surface; and means for attaching the first clamping member to the second clamping member with the first and second passageways substantially aligned with one another for clamping the first and second sheath-engaging surfaces together. A cable having a conductive outer sheath and one or more center conductors is extended through the first passageway; the conductive outer sheath is clamped between the first and second sheath-engaging surfaces; and the one or more center conductors are extended through the second passageway into the connector housing for connection to the center conductor connection means.

According to the invention, the first and second conductive members are fabricated from relatively thin metal strip which are formed in the desired shape utilizing low-cost stamping and forming manufacturing procedures. The fitting and the connector housing are formed of low-cost, moldable plastic materials which are effective in supporting and reinforcing the conductive members and in insulating the conductive members from other components of the connector.

The first and second conductive members preferably include relatively broad, disk-shaped portions which extend radially from the axial passageways in the first and second clamping members and which define the first and second sheath-engaging surfaces, respectively. When the cable is extended through the first clamping member, an exposed portion of the outer, conductive sheath of the cable is flared outwardly at substantially right angles to the axis of the cable so as to be positioned between the sheath-engaging surfaces of the first and second conductive members. Thereafter, when the first and second clamping members are attached together, for example, by threading the fitting onto the housing, the exposed conductive sheath will be firmly clamped between the two sheath-engaging surfaces to establish electrical contact between the conductive sheath of the cable and the connector. The one or more center conductors of the cable continue through the second passageway into the connector housing to be connected to center conductor connection means such as electrical contact means in the housing.

Although the metal strip of which the first and second conductive members are fabricated is quite thin and incapable of withstanding any significant clamping forces, the relatively thick plastic housing and fitting components provide support and reinforcement for the conductive members to ensure that a substantial clamping force can be obtained and maintained to reliably clamp the outer conductive sheath of the cable between the conductive members.

According to a further feature of the invention, at least one of the sheath-engaging surfaces is of bowed or dome-like configuration. Such a surface is able to collapse in a fashion similar to a bellville washer, recovering as necessary through spring action to compensate for movement of the fitting relative to the housing as a result of plastic creep. At least one of the sheath-engaging surfaces is also preferably provided with an irregular surface of, for example, a plurality of ridges or depressions, to more reliably grip and retain the outer conductive sheath between the sheath-engaging surfaces.

In general, the present invention provides an electrical connector having clamping means for reliably securing the outer conductive sheath of a cable to the connector that can be manufactured in large quantities at low cost. Assembly of the connector and of the cable to the connector can be made in the factory or in the field by unskilled personnel using ordinary tools such as a knife and a pair of pliers. The fitting can be attached to the housing by hand without the use of tools.

Further advantages and specific details of the invention will become apparent hereinafter in conjunction with the following detailed description of the preferred embodiments.

DETAILED DESCRIPTION OF THE PREFERRED EMBODIMENTS

Figure 1:
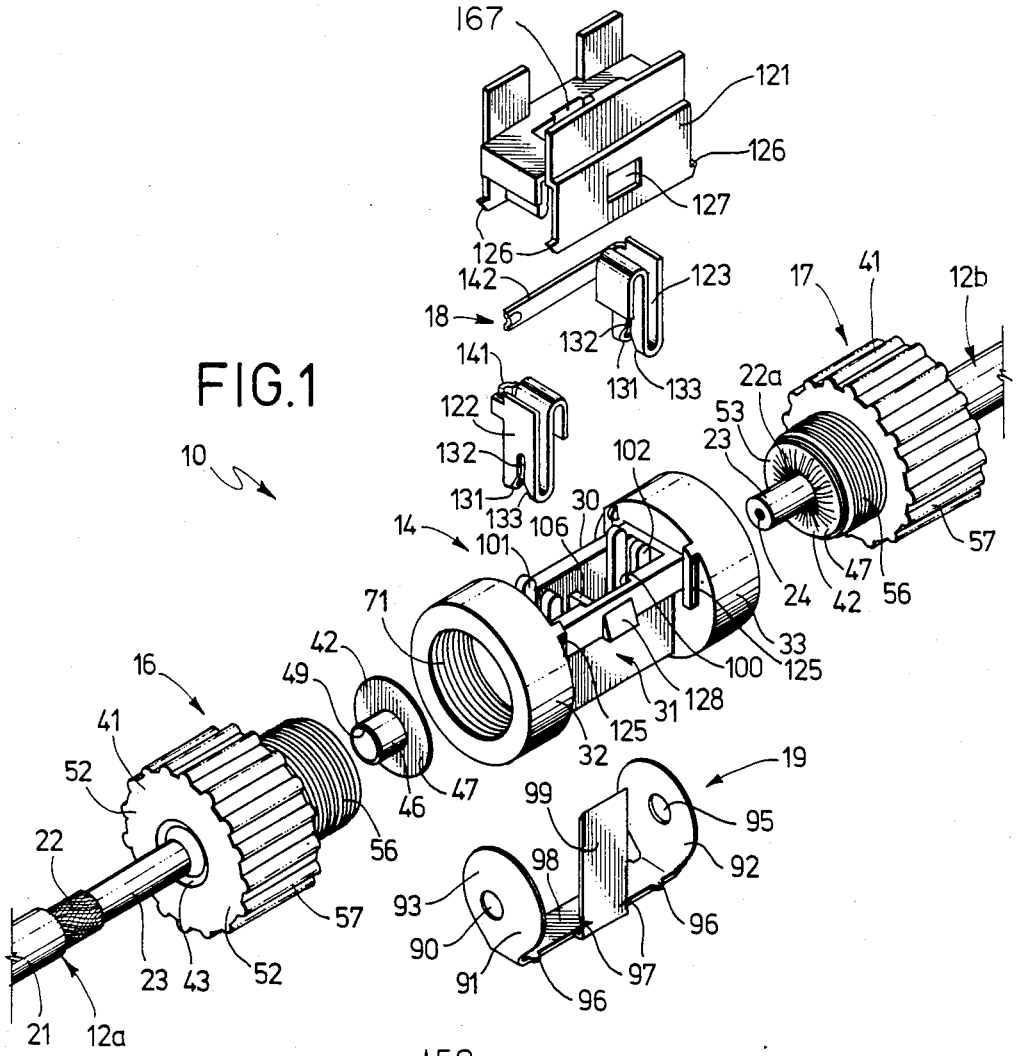
FIG. 1 is an enlarged, perspective, partially exploded view of a connector according to a presently preferred embodiment of the invention for connecting communications cables.

FIGS. 1–4 illustrate an electrical connector according to a presently preferred embodiment of the invention. The connector is generally designated by reference numeral 10 and is designed to connect two cables 12*a* and 12*b* of a communications cable system in a premises-wiring system, and to provide access to the wiring system to a workstation to link the workstation with other workstations to receive or transmit communications information carried by the system. It should be understood, however, that it is not intended to limit the invention to any particular application, but that the invention can be utilized in numerous applications wherein it is desired to electrically connect the outer conductive sheath of a cable to a connector.

The cables 12*a* and 12*b* comprise communications cables capable of carrying voice, electronic data and/or electrical power over one or more electrical conductors and/or one or more optical fibers gathered together within the cables. The cables include an outer jacket 21 of polymeric, insulative material coaxially and concentrically surrounding an electrically conductive sheath 22. Electrically conductive sheath 22, in turn, surrounds an insulative sheath 23 which contains the one or more transmission lines of the cables. The transmission lines can include one or more electrical conductors and/or one or more optical fiber conductors. For convenience of illustration, the cables described herein carry a single electrical center conductor 24.

Connector 10 generally comprises a connector housing assembly 14 and a pair of fitting assemblies 16 and 17. The housing assembly 14 will be described in greater detail hereinafter, but generally comprises an elongated, molded plastic housing 30 having a central portion 31 for receiving and supporting a contact assembly 18 and a grounding contact 19, and a pair of end portions 32 and 33 for receiving and supporting the fitting assemblies 16 and 17, respectively, when the connector is assembled.

Figures 2, 5, 6:
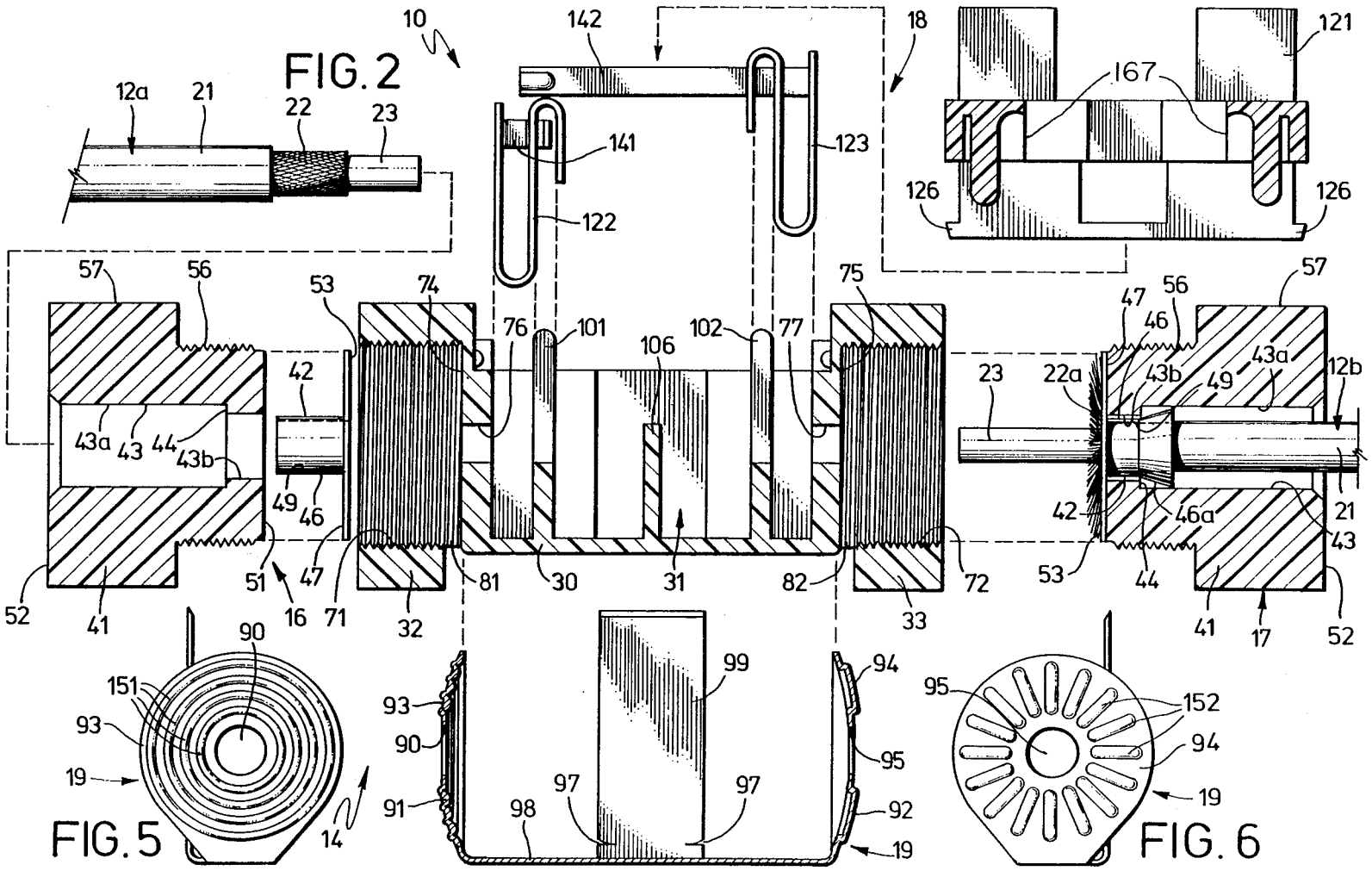
FIG. 2 is a partially exploded, cross-sectional view of the connector of FIG. 1.
FIGS. 5 and 6 illustrate alternative embodiments of the invention.
Figure 3:
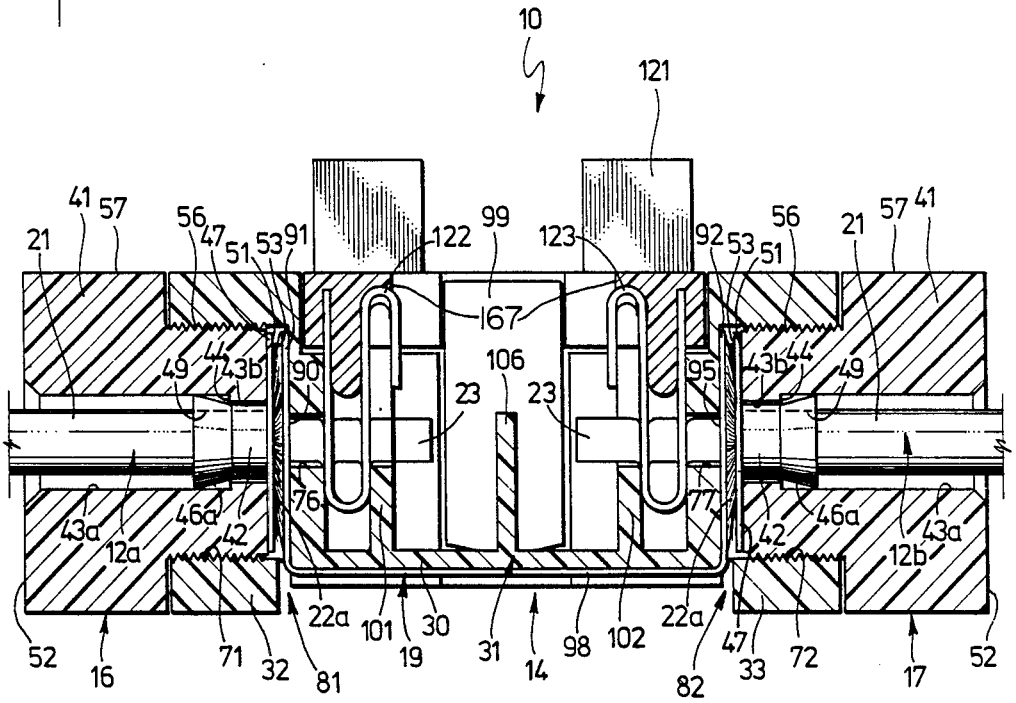
FIG. 3 is a cross-sectional view of the connector of FIGS. 1 and 2 in fully assembled form.

Fitting assemblies 16 and 17 are identical, and the same reference numerals are used herein to describe their construction. Each fitting assembly comprises a molded plastic, bolt-shaped fitting 41 having an electrically conductive member 42 attached thereto. Fitting 41 has a central passageway 43 extending axially therethrough, and an internal shoulder 44 of the passageway divides the passageway into first passageway portion 43*a* and second, reduced diameter, passageway portion 43*b*. Conductive member 42 comprises a relatively thin, metal member shaped to define a sleeve portion 46 and a flange portion 47. The sleeve and flange portions have a central opening 49 passing therethrough which is adapted to be aligned with the passageway 43 in the fitting 41 when the two components are assembled. More particularly, and as best shown in FIGS. 2 and 3, conductive member 42 is mounted to fitting 41 by extending the sleeve portion 46 into passageway 43 until the flange portion 47 contacts the end face 51 of fitting 41. Following insertion, the end of sleeve portion 46 extending into passageway portion 43*a* is flared outwardly, as indicated at 46*a* in FIGS. 2 and 3, by a suitable tool to secure the conductive member 42 to the fitting while allowing the conductive member to freely rotate relative to the fitting.

The fitting assemblies 16 and 17 so constructed comprise first clamping members and are adapted to receive the ends of cables 12*a* and 12*b*, respectively. Prior to insertion of the cables into the fittings, the cables are prepared by cutting and stripping off a length of their outer dielectric jacket 21 to expose a portion of the braided, conductive sheath 22 therein. A lesser portion of the conductive sheath is also removed to expose the inner dielectric sheath 23. The cables so prepared are then inserted into and through passageways 43 of the fittings 41 from ends 52 thereof and through openings 49 in the conductive members 42. Insertion of the cables is limited by impingement of their outer jackets 21 against the flared portions 46*a* of the sleeve 46; however, the conductive sheaths 22, the dielectric sheath 23, and the center conductors 24 pass fully through openings 49. The exposed conductive outer sheaths 22, after being passed through the fitting assemblies, are then fanned out, as shown at 22*a*, over the outer surfaces 53 of the radially extending flange portions 47 of the conductive members 42 to complete assembly of the cables to the fitting assemblies. As will be explained hereinafter, surfaces 53 function as first sheath-engaging surfaces for clamping the conductive sheaths to the connector 10.

Each of the fittings 41 includes an outer, threaded surface portion 56 for engagement with the housing assembly 14 and a fluted portion 57 to provide an enhanced gripping surface for the worker to assist in insertion of the fitting assemblies into the housing assembly.

Fitting assemblies 16 and 17 are adapted to be inserted into and secured to the end portions 32 and 33, respectively, of housing 30. End portions 32 and 33 define recesses 71 and 72, respectively, which are internally threaded for attachment to the threaded portions 56 of the fitting assemblies 16 and 17, respectively. The recesses 71 and 72 have back walls 74 and 75, respectively, having small central apertures 76 and 77, respectively, therein for receiving the center conductors 24 of the cables and their insulative coating 23, as shown in FIGS. 2 and 3. The housing is molded from an insulative plastic to define narrow slots 81 and 82 extending into the cavities 71 and 72, respectively, adjacent the back walls 74 and 75 thereof. These slots are adapted to receive the disk-like portions 91 and 92 of grounding contact 19. The outer surfaces 93 and 94 of disk-like portions 91 and 92, respectively, define second sheath-engaging surfaces to be clamped against the first sheath-engaging surfaces 53 on the flange portions 47 of the conductive members 42 to clamp the fanned-out portions 22*a* of outer conductive sheaths 22 therebetween when the fitting assemblies 16 and 17 are mounted to the housing assembly 14. Disk-like portions 91 and 92 include central apertures 90 and 95 for receipt of the center conductors 24 and their insulative sheaths 23 when the cables are extended into the housing assembly 14.

As best shown in FIG. 2, disk-like portions 91 and 92 of the grounding contact 19 are of domed resilient spring configuration to provide stored spring energy to compensate for any creep characteristics of the plastic components when the fitting assemblies 16 and 17 are screwed into the ends 32 and 33 of the housing 19. The grounding contact also includes a central strip 98 connecting the two disk-like ends 91 and 92 and a center ground bar 99 positioned at right angles along one side of the strip. The grounding contact is secured to the housing by four bosses 96 on the central strip (FIG. 1) which are pressed into the inner surfaces of the sides of the molded housing 30. Spring fingers 97 may also be provided on center ground bar 99 to engage a surface on the housing 30 to further lock the grounding contact to the housing after the grounding contact is inserted into the housing.

When grounding contact 19 is inserted into housing 30, domed, disk-like portions 91 and 92 extend into slots 81 and 82, respectively, such that the disk-like portions 91 and 92 are positioned within cavities 71 and 72 adjacent back walls 74 and 75 thereof. The center ground bar 99 extends through a slot 100 formed in the side of the housing 30.

To assemble connector 10, grounding member 19 is first inserted into housing 30. Fitting assemblies 16 and 17, having the ends of cables 12*a* and 12*b*, respectively, attached thereto, are then threaded into ends 32 and 33 of housing 30. Fanned-out braided portions 22*a* of outer sheaths 22 are sandwiched between sheath-engaging surfaces 53 on contact members 47 and sheath-engaging surfaces 93 and 94 on disk-like portions 91 and 92. As the fitting assemblies are screwed onto the housing, domed disk-like portions 91 and 92 collapse in a fashion similar to a bellville washer and are capable of recovering through spring action to an extent necessary to compensate for movement due to plastic creep of the threaded plastic elements. The conductive sheaths of the cables are thus firmly clamped to the connector and electrically connected to grounding contact 19 therein.

Preferably, second clamping surfaces 93 and 94 on disk-like portions 91 and 92 are roughened to more firmly clamp the fanned-out conductive sheaths 22*a* thereagainst. Such roughened surfaces can comprise, for example, a plurality of raised ridges or depressions on the surfaces. FIG. 5, for example, illustrates a plurality of circular ridges 151; and FIG. 6 illustrates a plurality of radial ridges or depressions 152 on surfaces 93 and 94, respectively.

During threading of the fitting assemblies 16 and 17 into housing 30, the dielectric covered, but unshielded, center conductors 24 of cables 12*a* and 12*b* pass through holes 90 and 95 in disk-like portions 91 and 92 of the grounding contact and into central cavity portion 31 of the housing. The covered center conductors pass over U-shaped rib structures 101 and 102 formed in central portion 31 which support the covered center conductors and function as anvils for connection of the center conductors to external circuitry. A centrally located wall 106 extends across the central cavity portion 31 and serves as a stop and a dielectric barrier to ensure that the center conductors entering the central portion of the housing from the opposite ends do not inadvertently contact one another. The housing assembly 14 is now ready to receive the contact assembly 18.

The contact assembly 18 comprises a contact housing 121 of molded plastic and a pair of contacts 122 and 123. The housing 121 has internal cavity sections to receive, support, and retain the contacts 122 and 123. In addition, the housing 121 has a tapered cavity area to receive and position the center ground bar 99 of the grounding contact when the contact assembly is mounted to the housing 30.

Contacts 122 and 123 each include depending U-shaped portions which define slots 131 (FIG. 1) to receive exposed insulating layers 23 of cables 12*a* and 12*b*. The edges 132 of the slots comprise cutting edges for cutting through insulation layers 23 when contact assembly 18 is inserted into housing 30 to provide electrical contact between center conductors 24 of cables 12*a* and 12*b* and contacts 122 and 123, respectively. Tapered areas 133 on the slots guide the wires into the slots and assist in cutting through insulation layers 23 to provide direct electrical contact with the center conductors of the cables. Insulation-penetrating contacts of the type utilized herein are known in the art and are disclosed, for example in U.S. Pat. No. 3,617,983.

Figure 7:
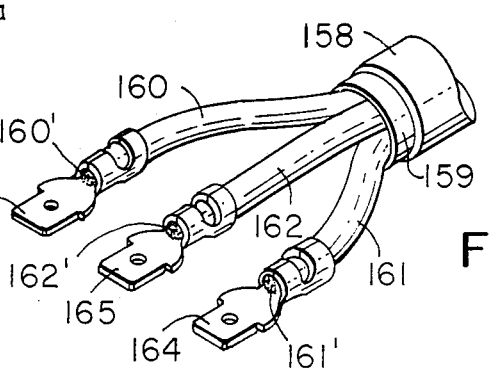
FIG. 7 is a perspective view of a portion of the plug shown in FIG. 4.
Figure 4:
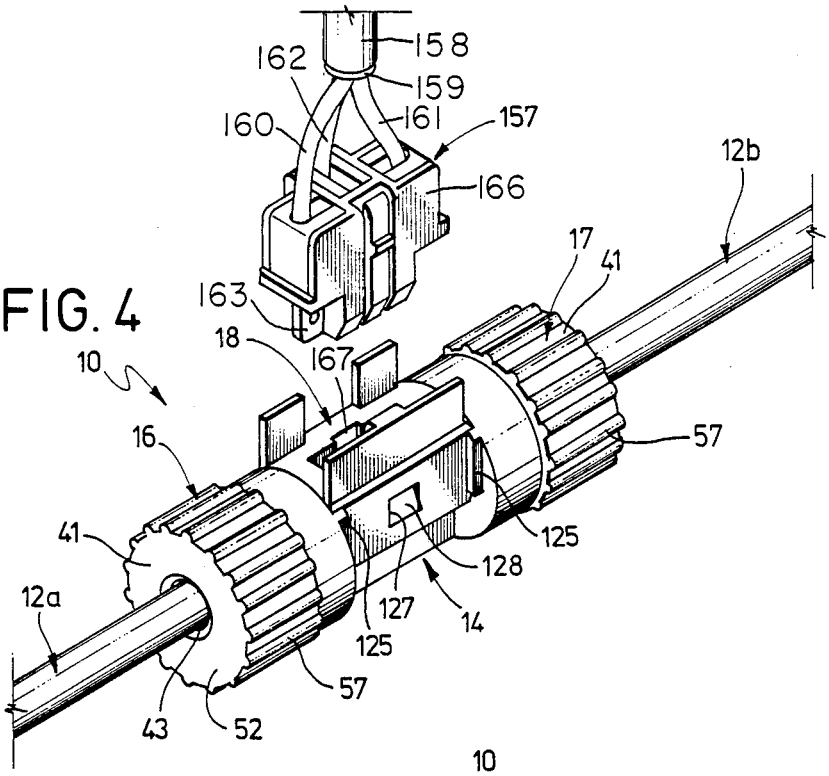
FIG. 4 is a perspective view of the connector of FIGS. 1–3 in fully assembled form together with an electrical plug.

On the upper ends of contacts 122 and 123 opposite slots 131 and extending at right angles along one side of the contacts, are switch arms 141 and 142. Switch arm 141 is fixed to contact 122 while longer switch arm 142 is movable with respect to contact 123. Switch arms 141 and 142 are designed to provide a current path between the contacts 122 and 123 and, hence, between center conductors 24 of cables 12*a* and 12*b*. An electrical plug 157 is shown in FIGS. 4 and 7 connected to an electrical cable 158 having a conductive sheath 159, a pair of signal carrying insulation covered conductors 160, 161 and insulation covered third conductor 162. The conductors 160, 161, 162 include corresponding conductive portions 160', 161'. 162' connected to corresponding conductive terminals 163, 164, 165 of the plug 157, each of said terminals having a blade configuration that is of the type disclosed in U.S. Pat. No. 2,791,755. The terminals 163, 164, 165 are mounted on an external surface of an insulative housing 166 of the plug 157, and are oriented on the housing 166 to face, respectively, the contacts 122, 123, and ground bar 99. At least a portion of the plug 157 and the terminals 163, 164, 165 are constructed for removable insertion into a plug receiving opening 167 of the housing 121. Upon said insertion, the housing 166 of the plug 157 urges the terminal 165 to engage compressibly and slidably impinge the ground bar 19 to establish an electrical connection of the conductive sheath 159 to the conductive sheaths 22, 22. Also upon said insertion, the housing 166 of the plug 157 urges the terminals 163, 164, 165 to engage compressibly and slidably impinge, respectively, the contacts 122, 123, and ground bar 19. The housing 166 of the plug engages and pivots the switch arm 142 and thereby disengages the switch arms 141, 142 and interrupts the current path between the contacts 122, 123. The current path instead is established from the contract 122, to the terminal 163, along the conductor 160, into workstation apparatus, not shown, from such apparatus, along the conductor 161, through the terminal 164 and through the contact 123. Thereby, an electrical series connection is established for the apparatus along the cables 12*a* and 12*b*, and the corresponding contacts 122, 123, and a ground electrical connection is established between the sheaths 22, 22, 159.

Contact assembly housing 121 contains latching features 126 on its lowermost four corners which engage projections 125 on housing 30 and latching features 127 cooperating with latching features 128 on each side of housing 30 to secure the housings 121 and 30 to one another.

With the present invention, the clamping members, defined by housing assembly 14 and fitting assemblies 16 and 17, are manufactured from stamped and formed metal strip and molded plastic rather than from machined, precision-made parts, resulting in a connector that is of lower cost and capable of high-volume production. The plastic housing and fittings provide sufficient support for the thin conductive clamping members to reliably clamp the outer conductive sheath between the clamping members when the connector is assembled. Assembly of connector 10 can be made in the factory or in the field by unskilled personnel, using common, ordinary tools.

While what has been described constitutes presently preferred embodiments of the invention, it should be understood that the invention can take numerous other forms. For example, although incorporated into a connector for connecting the ends of two cables in the disclosed embodiments, the clamping system of the present invention could readily be incorporated into other types of connectors for clamping the outer conductive sheaths of one or more cables. In addition, the configuration of the roughened clamping surfaces of the grounding contact could also take various other forms. Because the invention can take numerous forms, it should be understood that the invention should be limited only insofar as is required by the scope of the following claims.

I claim.

1. An electrical connector for a cable having a conductive outer sheath surrounding one or more center conductors comprising;

a first clamping member having a first axial passageway, said first clamping member comprising an insulative fitting and a first electrically conductive member mounted on said fitting and having a first substantially radially extending sheath-engaging surface;

a second clamping member having a second axial passageway, said second clamping member comprising an insulative connector housing having center conductor connection means and a second electrically conductive member mounted on said housing and having a second substantially radially extending sheath-engaging surface;

wherein said first and second sheath-engaging surfaces comprises substantially disk-shaped surfaces, and wherein an exposed portion of said conductive sheath is fanned-out substantially radially relative to the axis of said cable for being clamped between said first and second sheath-engaging surfaces;

and wherein at least one of said sheath-engaging surfaces is bowed outwardly toward the other sheath-engaging surface, said bowed surface flattening out upon clamping of said first and second sheath-engaging surfaces, but being capable of recovering through spring action to maintain the conductive sheath firmly clamped notwithstanding slight movement apart of the first and second sheath-engaging surfaces; and means for attaching said first clamping member to said second clamping member with said first and second passageways substantially aligned with one another for clamping said first and second sheath-engaging surfaces together;

whereby a cable having a conductive outer sheath and one or more center conductors is extended through said first passageway, said conductive outer sheath is clamped between said first and second sheath-engaging surfaces, and said one or more center conductors is extended through said second passageway into said connector housing for connection to said center conductor connection means.

2. The connector of claim 1 wherein said attaching means comprises means for threadably attaching said fitting to said housing.

3. The connector of claim 1 wherein said first conductive member is mounted on said fitting for rotation with respect thereto.

4. The connector of claim 1 wherein at least one of said sheath-engaging surfaces includes a plurality of surface features thereon for improved clamping of said conductive sheath.

5. The connector of claim 4 wherein said plurality of surface features comprise a plurality of raised ridges on said surface.

6. An electrical connector for cable having a conductive outer sheath surrounding one or more center conductors of the cable, comprising:

an insulative fitting having an axial passageway for receiving a cable therethrough;

a conductive member mounted on said fitting, said conductive member including a first opening aligned with said passageway and a radially extending flange having a first radially extending, sheath-engaging surface thereon;

an insulative connector housing;

a grounding contact member on said housing, said grounding contact member having a radially extending portion having a second radially extending, sheath-engaging surface thereon, said radially extending portion of said grounding contact member having a second opening aligned with a passageway in said housing;

said housing includes a threaded cavity for receiving said fitting and said conductive member mounted thereto and wherein said radially extending portion of said grounding contact member is positioned within said cavity, center conductor connection means in said housing; and means for mounting said fitting to said housing with the first and second conductive sheath-engaging surfaces opposing each other to form opposite sides of a conductive sheath-engaging clamp;

whereby an electrical cable passing through the passageway in the fitting and the opening in said conductive member has an exposed portion of its conductive outer sheath clamped in the conductive sheath-engaging clamp between said first and second sheath-engaging surfaces for grounding said outer conductive sheath, and has said at least one center conductive passing through the opening in the radially extending portion of the grounding contact member and through the housing passageway into said housing for connection to said center conductor connection means.

7. The connector of claim 6 wherein said conductive member is mounted to said fitting for relative rotation with respect thereto.

8. The connector of claim 6 wherein said radially extending portion of said grounding contact member is bowed outwardly toward the first sheath-engaging surface, said bowed, radially extending portion flattening out upon clamping of said first and second sheath-engaging surfaces, but being capable of recovering through spring action to maintain the conductive sheath firmly clamped notwithstanding slight movement apart of said first and second sheath-engaging surfaces.

9. The connector of claim 6 wherein said second sheath-engaging surface includes roughened surface features for enhancing the clamping of said conductive sheath.

10. The connector of claim 6 wherein said conductive member and said grounding contact member are formed of stamped metal sheet.

11. An electrical connector for establishing a disengageable electrical tap connection electrically in series between two signal transmitting conductors of corresponding cables, and for establishing a disengageable ground electrical tap connection with two conductive sheaths of corresponding said cables, comprising, a first fitting assembly and a second fitting assembly, each said fitting assembly including, a housing portion, a cable receiving passageway in the housing portion for receiving a corresponding one of the cables, a conductive clamping member mounted to the housing portion and a coupling portion on the housing portion.

a housing assembly including a housing having receiving means for receiving said cables and the coupling portions of said fitting assemblies, conductive means of the housing assembly having an electrical ground means and having clamping means, said clamping means being aligned with and cooperating with the clamping member of the first fitting assembly to engage and clamp the conductive sheath of a corresponding one of the cables, said clamping means being aligned with and cooperating with the clamping member of the second fitting assembly to engage and clamp the conductive sheath of a corresponding one of the cables, a first electrical contact and a second electrical contact of the housing assembly for electrical connection to corresponding said signal transmitting conductors of the cables, switching means disengageably connecting said first and said second electrical contacts, and the ground means and the switching means being aligned with a plug receiving opening of the housing assembly, whereby an electrical plug with separate electrical connections removeably in the plug receiving opening disengages said switching means and electrically connects the separate electrical connections, respectively, with the ground means, the first electrical contact and the second electrical contact.

12. An electrical connector as recited in claim 11 wherein, the coupling portions include respective rotatable portions, the receiving means rotatably receive corresponding said rotatable portions, and the clamping members are mounted for relative rotation with respect to said rotatable portions.

13. An electrical connector as recited in claim 11 wherein, the clamping members have roughened surfaces.

14. An electrical connector as recited in claim 11 wherein, the clamping means are resillient springs.

15. An electrical connector for a cable having a conductive outer sheath surrounding one or more signal transmitting conductors, comprising;

an insultative first clamping member, a first conductive member including a radially extending and sheath engaging first surface, the first conductive member being secured to said first clamping member and being relatively rotatable with respect to said first clamping member, an insulative second clamping member including a housing, conductive connection means in said housing for connection to a corresponding one or more signal transmitting conductors, a second conductive member secured to said second clamping member and including a radially extending and sheath engaging second surface, first and second passageways through the first and the second clamping members, respectively, first and second openings extending through the sheath engaging first and second surfaces, respectively, and means for assembling the first clamping means and the sheath engaging first surface onto the second clamping means and toward the sheath engaging second surface that opposes the sheath engaging first surface for clamping a conductive outer sheath of a cable, whereby a cable having a conductive outer sheath and one or more signal transmitting conductors is extended along said first passageway and said first opening, said conductive outer sheath is clamped between said sheath engaging first and second surfaces, and said one or more signal transmitting conductors is extended through said second passageway and through said second opening into said housing for connection to said conductive connection means.

16. An electrical connector as recited in claim 15, wherein each of the sheath engaging first and second surfaces are substantially disk shaped surfaces, and wherein an exposed portion of the conductive outer sheath is fanned out substantially radially of the cable for being clamped between the sheath engaging first and second surfaces.

17. An electrical connector as recited in claim 15, wherein the first conductive member includes a sleeve portion connected to the sheath engaging first surface, the first opening extends through the sleeve portion, said sleeve portion has an outwardly flared open end portion within the first passageway and the first opening extends through the sleeve portion.

18. An electrical connector as recited in claim 15, wherein at least one of the sheath engaging first and second surfaces is a bowed surface projecting outwardly toward the other, said bowed surface flattening out upon clamping of the outer conductive sheath and being constructed for recovering through spring action to maintain the outer conductive sheath firmly clamped notwithstanding slight movement apart of the sheath engaging first and second surfaces.

19. An electrical connector as recited in claim 15, wherein the second sheath engaging surface is roughened for enhancing the clamping of the conductive outer sheath.

* * * * *